US010941659B2

(12) United States Patent
Shan et al.

(10) Patent No.: US 10,941,659 B2
(45) Date of Patent: Mar. 9, 2021

(54) I-SHAPED WATER-RETAINING DAM FOR UNDERGROUND RESERVOIR IN COAL MINE

(71) Applicant: China University of Mining and Technology (Beijing), Beijing (CN)

(72) Inventors: Renliang Shan, Beijing (CN); Haochen Zhang, Beijing (CN); Xiangsong Kong, Beijing (CN)

(73) Assignee: China University of Mining and Technology (Beijing)

( * ) Notice: Subject to any disclaimer, the term of this patent is extended or adjusted under 35 U.S.C. 154(b) by 0 days.

(21) Appl. No.: 16/745,650

(22) Filed: Jan. 17, 2020

(65) Prior Publication Data

US 2020/0240270 A1 Jul. 30, 2020

(30) Foreign Application Priority Data

Jan. 29, 2019 (CN) ..... 201910087850.2

(51) Int. Cl.
*E21F 17/103* (2006.01)
*E21F 17/16* (2006.01)

(52) U.S. Cl.
CPC ..... *E21F 17/103* (2013.01); *E21F 17/16* (2013.01)

(58) Field of Classification Search
CPC ..... E02B 3/10; E21F 17/103; E21F 17/16
See application file for complete search history.

(56) References Cited

U.S. PATENT DOCUMENTS 3,396,539 A * 8/1968 Khan ..... F17C 3/005 405/53
3,972,272 A * 8/1976 Bagby ..... E21F 17/103 454/169

(Continued)

FOREIGN PATENT DOCUMENTS

CN 103422469 B 9/2014

OTHER PUBLICATIONS

Luo, et al., "Order of the State Administration of Work Safety, Regulations on Prevention and Control of Water in Coal Mines," Provisions for Mine Water Prevention and Control, Sep. 21, 2009, pp. 1-11.

(Continued)

*Primary Examiner* — Carib A Oquendo
(74) *Attorney, Agent, or Firm* — Lerner, David, Littenberg, Krumholz & Mentlik, LLP

(57) ABSTRACT

The present invention discloses an I-shaped water-retaining dam for an underground reservoir in a coal mine. The I-shaped water-retaining dam is located between coal pillar dams to isolate an underground reservoir from a corresponding coal roadway. The I-shaped water-retaining dam includes an upper flange plate, a web plate, and a lower flange plate from top to bottom, where a vertical face of a dam body is of an I shape; the upper flange plate extends into a roadway roof; two ends of the web plate are embedded into the coal pillar dams; and the lower flange plate extends into a floor. The I-shaped water-retaining dam is located in an underground coal roadway, and bears complex surrounding rock stress. The present invention effectively overcomes water seepage of a weak part at an upper part of a conventional I-shaped water-retaining dam.

17 Claims, 4 Drawing Sheets

(56) References Cited

U.S. PATENT DOCUMENTS

| | | | | |
|---|---|---|---|---|
| 4,818,144 | A * | 4/1989 | Mraz | E21F 17/00 299/12 |
| 5,401,120 | A * | 3/1995 | Hussey | E21F 1/145 264/267 |
| 5,934,990 | A * | 8/1999 | Steffenino | E21F 17/103 454/170 |
| 6,450,735 | B1 * | 9/2002 | Mills | E21F 17/103 405/150.2 |
| 2003/0017005 | A1 * | 1/2003 | Kennedy | E21F 17/103 405/132 |
| 2007/0297861 | A1 * | 12/2007 | Sisk | E21F 17/103 405/259.1 |
| 2011/0013991 | A1 * | 1/2011 | Watson | E21F 17/103 405/284 |
| 2016/0176639 | A1 * | 6/2016 | Gu | E02B 3/10 405/55 |
| 2016/0201460 | A1 * | 7/2016 | Gu | E02B 3/10 405/55 |
| 2018/0080323 | A1 * | 3/2018 | Kennedy | E21F 1/14 |

OTHER PUBLICATIONS

Wang, et al., "Provisional Measures on Penalty Management in Safe Production Supervision, No. 15 of State Administration of Work Safety," Coal Mine Safety Regulation, Nov. 3, 2004, pp. 4-11.

* cited by examiner

I-SHAPED WATER-RETAINING DAM FOR UNDERGROUND RESERVOIR IN COAL MINE

CROSS REFERENCE TO RELATED APPLICATIONS

This application claims priority from Chinese application number 201910087850.2, filed Jan. 29, 2019, the disclosure of which is hereby incorporated herein by reference.

TECHNICAL FIELD

The present invention relates to the inter-discipline of mining engineering and hydraulic engineering, and in particular, to an I-shaped water-retaining dam for an underground reservoir in a coal mine.

BACKGROUND

"Coal Mine Safety Regulation" and "Provisions for Mine Water Prevention and Control" had specific regulations on the construction of a sluice gate and a floodgate wall. However, these regulations are mainly based on water prevention and control without considering a long-term water storage function of an underground reservoir. In hydraulic engineering, the dam construction of a surface reservoir is stipulated in more details. Although related research has been carried out on the construction of water-retaining dams of distributed underground reservoirs in a coal mine, a dam for a surface reservoir cannot be constructed in a same way as a water-retaining dam for an underground reservoir.

A dam for a surface reservoir is subject to only water pressure and its own gravity; while a dam for an underground reservoir in a coal mine bears complex force including both lateral water pressure and surrounding rock stress from surrounding coal pillars or rock mass.

Moreover, because rock strata above the underground reservoir are unstable, the dam will be impacted by caving of the rock strata, as well as mining in a same coal seam and different coal seams and mining tremor.

At present, a large number of water-retaining dams for underground reservoirs in coal mines are mainly wall-type water-retaining dams. In actual applications, when a water-retaining dam bears relatively high surrounding rock pressure, the dam will exert relatively high pressure on both upper surrounding rock and a floor. Such pressure easily causes an increase in corresponding cracks or local buckling failures. Usually, roof caving and water seepage occur at an upper part of the dam, and differential settlement occurs due to the floor heave, which causes certain impact on the actual safe use.

The patent numbered 103422469B discloses an artificial water-retaining dam for an underground reservoir in a coal mine. The artificial water-retaining dam is embedded into coal pillar dams and the surrounding rock around an auxiliary roadway. Moreover, the artificial water-retaining dam has an arc-shaped cross section, and includes a concave surface facing towards the underground reservoir. In this patent, anchor rods are further disposed around the dam. This patent provides related research on a water-retaining dam for an underground reservoir in a coal mine. However, it focuses on the stress problem of a main dam surface of a dam body without considering that local areas of joints between the dam body and a roof and floor are weak. Moreover, no dealing means are proposed.

Therefore, based on the present situation, an I-shaped water-retaining dam for an underground reservoir in a coal mine is proposed, to overcome the collapse of a weak part of a roof of a coal roadway, reduce floor cracks, and prevent a local buckling failure of a floor.

This is of great significance to the effective utilization of groundwater in a coal mine and the coal mine safety.

SUMMARY

An objective of the present invention is to overcome the shortcomings in the prior art, and provide an I-shaped water-retaining dam. The dam bears low direct stress, and can overcome the collapse of a weak part of a roof of a coal roadway and prevent excessively high local stress on a floor, thereby improving the overall safety of an underground reservoir.

An I-shaped water-retaining dam for an underground reservoir in a coal mine is provided, where the I-shaped water-retaining dam is located between coal pillar dams on a left and right side of a roadway, and is configured to isolate an underground reservoir from the roadway and block a water source in the underground reservoir; a dam body of the I-shaped water-retaining dam includes an upper flange plate, a web plate, and a lower flange plate from top to bottom; a vertical section of the dam body perpendicular to a dam face is of an I shape; left and right ends of the upper flange plate, the web plate, and the lower flange plate are embedded into the coal pillar dams; the upper flange plate is embedded into surrounding rock of a roadway roof; and the lower flange plate is embedded into surrounding rock of a roadway floor.

Preferably, the upper flange plate is formed by extending all around based on a length and thickness of the web plate, and/or the lower flange plate is formed by extending all around based on the length and thickness of the web plate; and the upper flange plate and the lower flange plate preferably extend at least 50 cm.

Preferably, the lower surface of the upper flange plate is flush with the roadway roof and/or the upper surface of the lower flange plate is flush with the roadway floor; and the upper flange plate and the lower flange plate are preferably concrete structures with a thickness of 30-50 cm.

Preferably, a depth at which the upper flange plate is embedded into the roof surrounding rock is 50-100 cm; and/or a depth at which the lower flange plate is embedded into the floor surrounding rock is 50-100 cm Preferably, multiple groups of anchor rods are arranged at a joint between a part of the upper flange plate embedded into the roof surrounding rock and the roof surrounding rock in a width direction of the dam body; the anchor rod passes through a loose layer of the roof surrounding rock and is inserted into stable rock mass; and preferably, there are three anchor rods in each group of anchor rods, where one anchor rod is perpendicular to the upper flange plate, the other two anchor rods are symmetrically distributed at an angle of 45° from a horizontal direction of the upper flange plate, and in this way, a stable and dense anti-seepage area can be formed after grouting.

Preferably, multiple groups of anchor rods are arranged at a joint between a part of the lower flange plate embedded into the floor surrounding rock and the floor surrounding rock in a width direction of the dam body; the anchor rod passes through a loose layer of the floor surrounding rock and is inserted into stable rock mass; and preferably, there are three anchor rods in each group of anchor rods, where one anchor rod is perpendicular to the lower flange plate, the other two anchor rods are symmetrically distributed at an angle of 45° from a horizontal direction of the lower flange plate, and in this way, a stable and dense anti-seepage area is formed after grouting.

Preferably, multiple rows of anchor rods are arranged at a joint between an embedded part on two sides of the web plate and the coal pillar dams in a height direction of the dam body; each row of anchor rods is arranged perpendicular to the coal pillar dam; and the anchor rod passes through a loose layer of the coal pillar dam and is inserted into a stable coal pillar dam.

Preferably, joist steel arranged in a # shape is disposed inside the web plate; and preferably, the vertical joist steel extends into the upper flange plate and lower flange plate.

Preferably, a reinforced steel structure is reserved in a position in which the lower flange plate is located on the web plate, facilitating connection to the web plate, to form the overall lower flange plate through overall pouring.

Preferably, an anti-seepage layer and a support layer are further successively arranged on a side of the web plate facing the underground reservoir, and the web plate, the anti-seepage layer, and the support layer form the I-shaped water-retaining dam of a multilayer dam body structure; preferably, the anti-seepage layer is a gravel structure layer or a loess structure layer with a thickness of 1.5-2.5 m; preferably, the support layer is a brick-concrete structure layer with a thickness of 1.5-2.0 m; and preferably, a waterproof layer is coated between the support layer, the anti-seepage layer, and the web plate.

Preferably, a ratio of the thickness of the web plate of the I-shaped water-retaining dam to a width of the roadway is 0.1-0.3.

Preferably, a pipeline opening and an emergency observation borehole are arranged between the support layer, the anti-seepage layer, and the web plate.

After the above technical solution is adopted, the following beneficial effects are achieved: (1) The lower flange plate is disposed below the web plate. Because the lower flange plate has a large base area, base pressure can be reduced. In addition, a base bearing capacity can be improved, the foundation integrity can be more effectively enhanced, and uneven settlement can be adjusted. This can effectively restrain the crack propagation of lower rock of the floor and reduce a buckling failure of the floor. (2) The upper flange plate is disposed above the web plate, and the upper flange plate has a relatively large area. Therefore, surrounding rock pressure of upper surrounding rock can be relatively scattered, so as to weaken the stress concentration of the upper surrounding rock. This correspondingly reduces local pressure at a joint between upper surrounding rocks, and effectively restrains the crack propagation of the upper surrounding rock, thereby improving the safety. (3) Left and right ends of the upper flange plate, the web plate, and the lower flange plate are embedded into the coal pillar dams; the upper flange plate is embedded into the surrounding rock of the roadway roof; and the lower flange plate is embedded into the surrounding rock of the roadway floor. In this way, the I-shaped water-retaining dam, surrounding coal pillar dams, and surrounding rock jointly form the water-retaining dam for an underground reservoir, to enhance the overall firmness, stability, and safety of the dam body. (4) Compared with a case in which only the web plate is disposed, the upper flange plate and the lower flange plate have larger lengths and widths. This can effectively block a seepage path of reservoir water through the upper and lower surrounding rock, and prevent water seepage of weak parts of the upper and lower surrounding rock, thereby ensuring the stability and safety of the dam body. (5) Embedding depths of the upper flange plate and the lower flange plate in the surrounding rock are increased, which can further improve the stability of the upper flange plate and the lower flange plate. Moreover, at a larger embedding depth, a permeability coefficient of the surrounding rock is smaller, and the rock mass is less cracked. This can more effectively block the seepage path and reduce water seepage. (6) Anchor rods are arranged on two sides of the upper flange plate, the lower flange plate, and the web plate, and are anchored at stable surrounding rock and the coal pillar dams, which can further improve the stability of the surrounding rock and its two sides. (7) An anti-seepage area can be formed by anchor grouting, which can further enhance an anti-seepage effect of a base of the lower flange plate.

The accompanying drawings described herein are provided for further understanding of the present invention, and constitute a part of this application, but do not constitute a limitation to the present invention. All reference signs are as follows:

1-web plate, 2-lower flange plate; 3-upper flange plate; 4-roadway; 5-underground reservoir; 6-anchor rod; 7-surrounding rock; 8-coal pillar dam; 9-joist steel; H-web plate thickness; L1-web plate width; L2-roadway width; S1-extending length of a flange plate based on the web plate length; S2-extending width of a flange plate based on the web plate width; and Are-anti-seepage area.

DETAILED DESCRIPTION

To make the objectives, technical solutions, and advantages of the embodiments of the present invention clearer, the following further describes in detail the embodiments of the present invention with reference to the embodiments and the accompanying drawings. Herein, exemplary embodiments and description of the present invention are intended to explain the present invention, but are not intended to limit the present invention.

In the description of the present invention, it should be understood that orientations or position relationships indicated by terms "upper", "lower", "front", "back", "left", "right", "top", "bottom", "inner", "outer", etc. are orientations or position relationships shown in the accompanying drawings, and these terms are only used to facilitate description of the present invention and simplify the description, but not to indicate or imply that the mentioned apparatus, component, or structure must have a specific orientation and must be established and operated in a specific orientation, and therefore these terms cannot be understood as a limitation to the present invention.

It should be further understood that, terms "include/including", "comprise", or any other variations thereof are intended to cover non-exclusive including, so that a product, a device, a process, or a method including a series of elements not only includes those elements, but also includes other elements that are not explicitly listed, or also includes inherent elements of the product, the device, the process, or the method. When there are no more restrictions, elements defined by the statement "including/including . . . " or "comprise . . . " do not exclude that there are other same elements in a product, a device, a process, or a method including the elements.

The following further describes a specific implementation method of the present invention with reference to the accompanying drawings.

Figure 1:
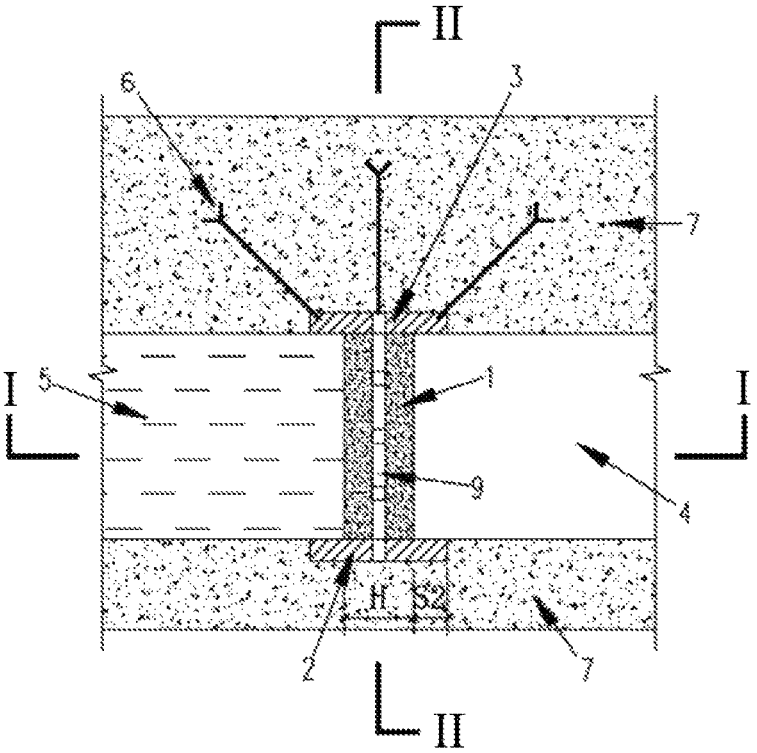
FIG. 1 is a schematic structural diagram of a longitudinal section of an I-shaped water retaining dam for an underground reservoir in a coal mine according to an embodiment of the present invention.
Figure 2:
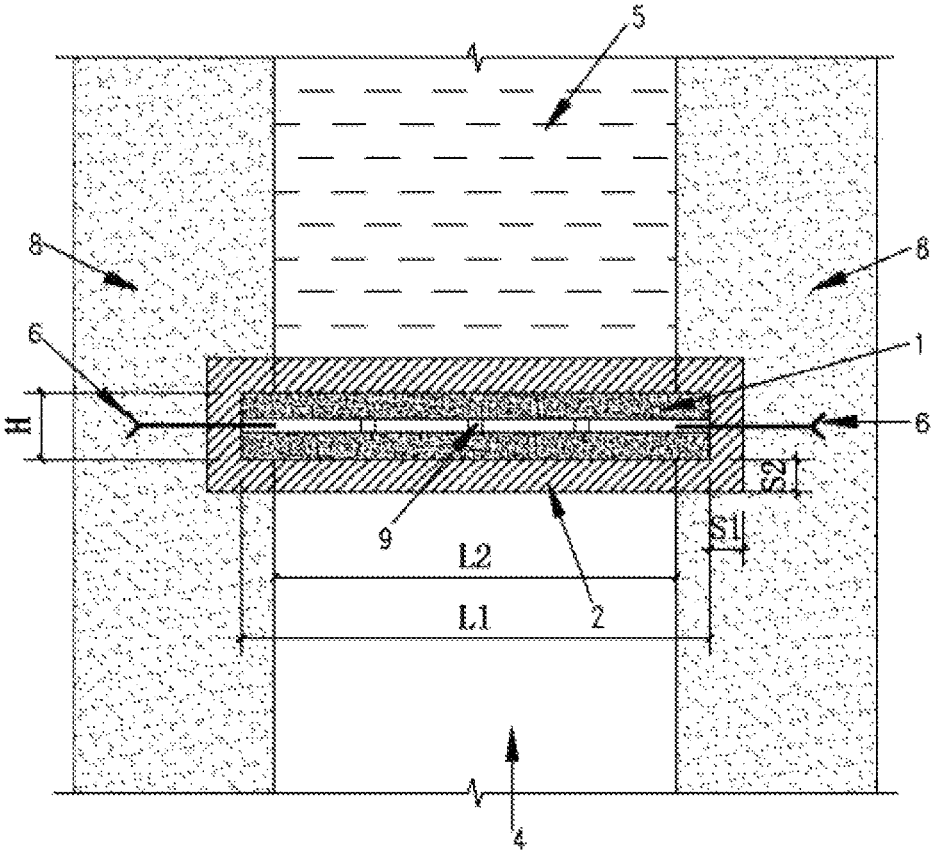
FIG. 2 is a diagram of a section along I-I in FIG. 1.

As shown in FIG. 1 and FIG. 2, an underground reservoir 5 in a coal mine is configured to store an underground water source of the coal mine, facilitate recycling of groundwater resources. An I-shaped water-retaining dam is constructed between coal pillar dams 8 on a left and right side of a roadway, and is configured to isolate the underground reservoir 5 from the roadway 4 and block a water source in the underground reservoir 5.

In the present invention, "upper" means a side facing a view and close to a roadway roof, and "lower" means a side facing the view and close to a roadway floor. Referring to FIG. 1 and FIG. 2, H represents a thickness of a web plate 1; L1 represents a width of the web plate 1; L2 represents a width of the roadway 4; S1 is an extending length of a flange plate based on the web plate length; S2 is an extending width of a flange plate based on the web plate width; or in other words, the web plate length is actually L1+2*S1, and the web plate width is H+2*S2.

A vertical section of the I-shaped water-retaining dam perpendicular to a dam face is of an I shape. A dam body of the I-shaped water-retaining dam includes an upper flange plate 3, the web plate 1, and a lower flange plate 2 from top to bottom. The upper flange plate 3, the web plate 1, and the lower flange plate 2 are integrally poured. The web plate 1 is a wall-type plate, and a left and right side of the web plate 1 extend into the coal pillar dams 8. In this embodiment, the thickness of the web plate 1 is 1.00 m. The I-shaped water-retaining dam is subject to surrounding rock pressure and its own gravity. In the present invention, the lower flange plate 2 is disposed below the web plate as a lower base of the I-shaped water-retaining dam. The surrounding rock pressure and its own gravity are exerted on the lower flange plate 2 at a lower part of the dam body. The lower flange plate is formed by extending based on the length and width of the web plate, and has a large base area. Therefore, base pressure can be reduced, and excessively high local pressure can be prevented. In addition, a base bearing capacity can be improved, the foundation integrity can be more effectively enhanced, and uneven settlement can be adjusted. This can effectively restrain the crack propagation of lower rock of the floor and reduce a buckling failure of the floor.

Referring to FIG. 1, the lower flange plate 2 extends into surrounding rock 7 of a roadway floor, and the lower flange plate 2 is of a concrete structure with a thickness of 30-50 cm. Preferably, the lower flange plate 2 extends into the roadway floor by a length equal to its own thickness, that is, the upper surface of the lower flange plate 2 is flush with the roadway floor. The lower flange plate 2 is of a concrete structure, and can improve the base bearing capacity, and can more effectively enhance the foundation integrity and adjust uneven settlement. This can effectively restrain the crack propagation of the lower rock of the floor and reduce the buckling failure of the floor In addition, the I-shaped water-retaining dam is provided with the upper flange plate 3.

The upper flange plate is formed by extending based on the length and width of the web plate, and has a relatively large area. Therefore, surrounding rock pressure of upper surrounding rock can be relatively scattered, so as to effectively weaken the stress concentration of the upper surrounding rock. In addition, local pressure of the roadway roof can be reduced, excessive local pressure can be avoided, and the crack propagation can be restrained, thereby further improving the safety.

The upper flange plate 3 of a concrete structure with a thickness of 30-50 cm extends into surrounding rock 7 of the roadway roof. Preferably, the upper flange plate 3 extends into the roadway roof by a length equal to its own thickness, that is, the lower surface of the upper flange plate 3 is flush with the roadway roof. The upper flange plate 3 is of a concrete structure, which can strengthen a weak point at a joint between upper surrounding rock and the dam body, improve partial water retention and prevent water from flowing through the weak point at the joint, and support and strengthen the upper surrounding rock 7 to a certain extent.

Left and right ends of the upper flange plate, the web plate, and the lower flange plate are embedded into the coal pillar dams; the upper flange plate is embedded into the surrounding rock of the roadway roof; and the lower flange plate is embedded into the surrounding rock of the roadway floor. In this way, the I-shaped water-retaining dam, surrounding coal pillar dams, and surrounding rock jointly form the water-retaining dam for an underground reservoir, to enhance the overall firmness, stability, and safety of the dam body.

In this embodiment, the upper flange plate 3 extends at least 50 cm along each direction based on a length and thickness of the web plate 1 to reach a final size of the upper flange plate 3, and the lower flange plate 2 extends at least 50 cm along each direction based on the length and thickness of the web plate 1 to reach a final size of the lower flange plate 2, that is, S1=50 cm and S2=50 cm. In this way, a vertical surface of the dam body of the I-shaped water-retaining dam is also of an I shape. Therefore, compared with a case in which only the web plate is disposed, the upper flange plate and the lower flange plate have larger lengths and widths. This can effectively block a seepage path of reservoir water through the web plate and the upper and lower surrounding rock, and prevent water seepage at weak parts of the upper and lower surrounding rock, thereby ensuring the stability and safety of the dam body.

The web plate 1 has good anti-seepage performance In addition, the web plate 1 is embedded into the surrounding coal pillar dams 8. Due to good mechanical properties of concrete, the strength of the I-shaped water-retaining dam can be improved.

It should be noted that, thicknesses of the upper flange plate and the lower flange plate of the I-shaped water-retaining dam is not limited to 30 cm; extending lengths of the upper flange plate and the lower flange plate based on the length and width of the web plate is not limited to 50 cm; and a thickness of the concrete structure of the web plate is not limited to 1.00 cm.

Referring to FIG. 2, FIG. 2 is a diagram of a section along I-I in FIG. 1, that is, a schematic diagram of a horizontal section of the I-shaped water-retaining dam for an underground reservoir in a coal mine in the present invention. In FIG. 2, H represents the thickness of the web plate 1; L2 represents a width of the roadway 5; and a ratio of the thickness H of the web plate to the width L2 of the roadway is 0.1-0.3, and is preferably 0.18-0.20. In actual application, a thickness of the I-shaped water-retaining dam, an embedding depth of the I-shaped water-retaining dam in surrounding rock, etc. are calculated based on technical parameters of water storage of an underground reservoir, to form a relatively safe Ishaped water-retaining dam.

Figure 3:
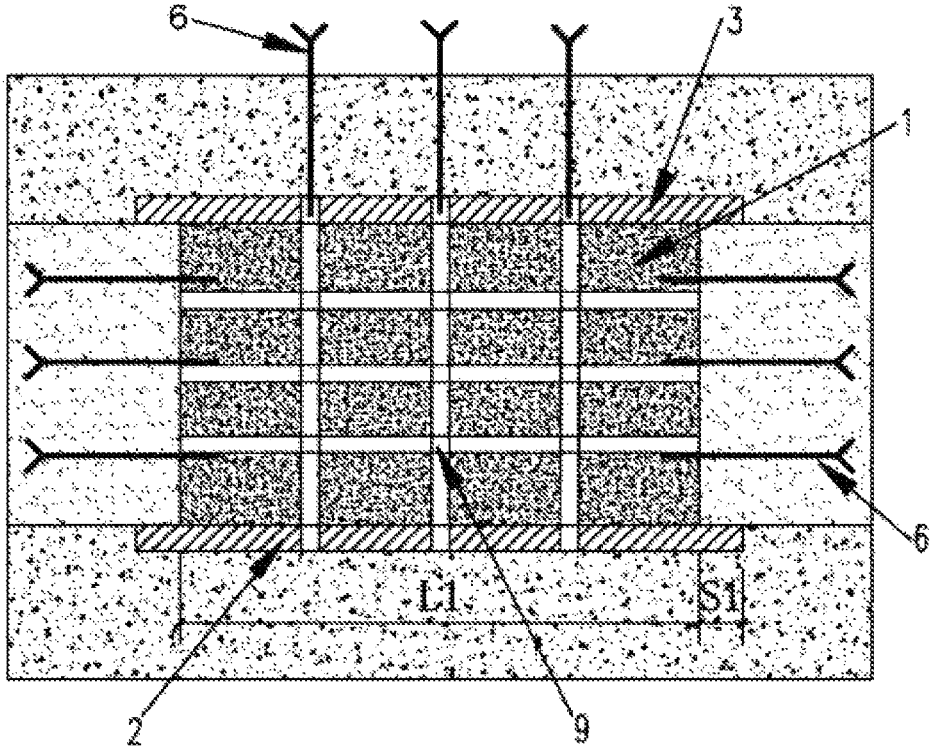
FIG. 3 is a diagram of a section along II-II in FIG. 1.

Referring to FIG. 1 and FIG. 3, a depth at which the upper flange plate 3 is embedded into the roof surrounding rock is preferably 50-100 cm, and a depth at which the lower flange plate 2 is embedded into the floor surrounding rock is 50-100 cm. Embedding depths of the upper flange plate and the lower flange plate in the surrounding rock are increased, which can further improve the stability of the upper flange plate and the lower flange plate. Moreover, at a larger embedding depth, a permeability coefficient of the surrounding rock is smaller, and the rock mass is less cracked. This can more effectively block the seepage path and reduce water seepage.

Referring to FIG. 1, three groups of anchor rods 6 are arranged at an embedded part of the upper flange plate 3 extending into the surrounding rock 7. There may alternatively be three or more anchor rods 6 in each group of anchor rods 6. Multiple anchor rods 6 may be arranged at intervals of 50 cm, where one anchor rod is perpendicular to the upper flange plate, the other two anchor rods are symmetrically distributed at an angle of 45° from a horizontal direction of the upper flange plate. A length of the anchor rod 6 is 1.8-2.5 m.

Preferably, a thickness at which the anchor rod 6 is inserted into rock strata is 1.5-2.0 m.

Figure 4:
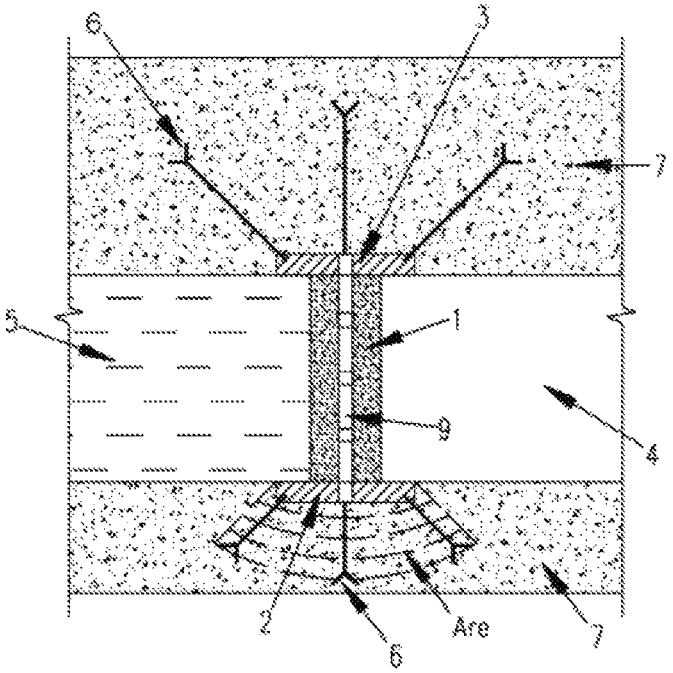
FIG. 4 is a schematic diagram of an anti-seepage area of a lower flange plate according to the present invention.

Further, referring to FIG. 4, three groups of anchor rods 6 are arranged at an embedded part of the lower flange plate 2 extending into the surrounding rock 7. There may alternatively be three or more anchor rods 6 in each group of anchor rods 6. Multiple anchor rods 6 may be arranged at intervals of 50 cm, where one anchor rod is perpendicular to the lower flange plate, and the other two anchor rods are symmetrically distributed at an angle of 45° from a horizontal direction of the lower flange plate. In this way, the compressive strength of basement surrounding rock can be improved, and a buckling failure resulting from cracks can be prevented. Moreover, a stable and dense anti-seepage area Are can be formed after grouting, effectively preventing water seepage at a joint between the lower flange plate and surrounding rock. A length of the anchor rod 6 is 1.8-2.5 m. Preferably, a thickness at which the anchor rod 6 is inserted into rock strata is 1.5-2.0 m.

After passing through loose layers of the coal pillar dam 8 and the surrounding rock 7, the anchor rod 6 is inserted into the rock strata (not shown in the figure). The rock strata have a relatively dense texture. The anchor rod 6 is inserted into the rock strata, which is beneficial to improve the connection stability between the I-shaped water-retaining dam 1, coal pillar dams 8, and surrounding rock 7.

Two ends of the web plate 1 extend into the coal pillar dams 8; the upper flange plate 3 and the lower flange plate 2 extend into the surrounding rock 7; and parts of the anchor rods 6 are embedded into the two ends of the web plate 1, and the anchor rods 6 are disposed in the rock mass, to ensure the safety.

Still referring to FIG. 3, FIG. 3 is a diagram of a section along II-II in FIG. 1, that is, a schematic diagram of a vertical section of the I-shaped water-retaining dam for an underground reservoir in a coal mine in the present invention. In FIG. 3, depths at which the two ends of the web plate 1 are embedded into the coal pillar dams 8 are 50-100 cm.

Specifically, three anchor rods 6 are arranged at each embedded part between two sides of the web plate 1 and the coal pillar dams 8. There may alternatively be three or more anchor rods 6. Multiple anchor rods 6 may be arranged at intervals of 50 cm. A length of the anchor rod 6 is 1.8-2.5 m, and a thickness at which the anchor rod 6 is inserted into the stable coal pillar dam 8 is 1.5-2.0 m. In addition, the anchor rod 6 should be vertical to ensure better stability.

The anchor rod 6 can be supported by reinforced steel, which can connect the dam body of the I-shaped water-retaining dam to the coal pillar dams 8, further enhancing the strength of the I-shaped water-retaining dam.

Further, as shown in FIG. 3, horizontal and vertical joist steel 9 are further disposed inside the web plate 1. The joist steel 9 is formed inside the whole web plate in a #-shaped arrangement. A length of the vertical joist steel 9 is equal to a height of the web plate 1. The vertical joist steel may further extend into the upper flange plate and the lower flange plate. A length of the horizontal joist steel 9 is equal to the width of the web plate 1. The joist steel can enhance the overall strength of the I-shaped water-retaining dam, which sufficiently withstands water pressure of the underground reservoir. Preferably, the joist steel 9 can also form other shapes. For example, the joist steel 9 can be formed in a concrete web plate in a cross manner in cooperation with reinforcing meshes.

In this embodiment, a cross section of the I-shaped water-retaining dam is a rectangle.

Preferably, a reinforced steel structure is reserved in a position in which the lower flange plate 4 is located on the web plate 1, facilitating connection to the web plate between the upper flange plate and the lower flange plate, to form overall pouring.

In this embodiment, an emergency observation borehole (not shown in the figure) is reserved in each web plate 1. To prevent a sudden increase in water pressure in the reservoir from affecting the safe operation of the underground reservoir, the emergency observation borehole is provided in an appropriate position of the I-shaped water-retaining dam. On one hand, observation, sampling, and detection are conducted on water pressure, a water level, and water quality in the reservoir by using the emergency observation borehole. On the other hand, a valve is used, and starting pressure of the valve is set, to ensure that the valve can be automatically or manually started when warning water pressure is reached, thereby ensuring the operation safety of the underground reservoir.

Thus, a person skilled in the art should be aware that although exemplary embodiments of the present invention have been shown and described in detail in this specification, many other variations or modifications conforming to the principle of the present invention can be still determined or deduced directly according to the content disclosed in the present invention, without deviating from the spirit and scope of the present invention. Therefore, the scope of the present invention shall be understood and considered as covering all such other variations or modifications.

What is claimed is:

1. An I-shaped water-retaining dam for an underground reservoir in a coal mine, which is located between coal pillar dams on a left and right side of a roadway and is configured to isolate the underground reservoir from the roadway and block a water source in the underground reservoir, comprising a dam body of the I-shaped water-retaining dam which comprises an upper flange plate, a web plate, and a lower flange plate from top to bottom, wherein a vertical section of the dam body perpendicular to a dam face is of an I shape; left and right ends of the upper flange plate, the web plate, and the lower flange plate are embedded into the coal pillar dams; the upper flange plate is embedded into surrounding rock of a roadway roof; and the lower flange plate is embedded into surrounding rock of the roadway floor.

2. The I-shaped water-retaining dam for an underground reservoir in a coal mine according to claim 1, wherein the upper flange plate is formed by extending beyond the web plate both in directions of a length and a thickness of the web plate, and/or the lower flange plate is formed by extending around beyond the web plate both in directions of the length and the thickness of the web plate.

3. The I-shaped water-retaining dam for an underground reservoir in a coal mine according to claim 2, wherein the upper flange plate and the lower flange plate extend at least 50 cm.

4. The I-shaped water-retaining dam for an underground reservoir in a coal mine according to claim 1, wherein a lower surface of the upper flange plate is flush with the roadway roof and/or an upper surface of the lower flange plate is flush with the roadway floor.

5. The I-shaped water-retaining dam for an underground reservoir in a coal mine according to claim 4, wherein the upper flange plate and the lower flange plate are concrete structures with a thickness of 30-50 cm.

6. The I-shaped water-retaining dam for an underground reservoir in a coal mine according to claim 1, wherein a depth at which the upper flange plate is embedded into the roof surrounding rock is 50-100 cm; and/or a depth at which the lower flange plate is embedded into the floor surrounding rock is 50-100 cm.

7. The I-shaped water-retaining dam for an underground reservoir in a coal mine according to claim 1, wherein multiple groups of anchor rods are arranged at a joint between a part of the upper flange plate embedded into the roof surrounding rock and the roof surrounding rock in a width direction of the dam body; the anchor rod passes through a loose layer of the roof surrounding rock and is inserted into stable rock mass.

8. The I-shaped water-retaining dam for an underground reservoir in a coal mine according to claim 7, wherein there are three anchor rods in each group of anchor rods, wherein one anchor rod is perpendicular to the upper flange plate, the other two anchor rods are symmetrically distributed at an angle of 45° from a horizontal direction of the upper flange plate, and in this way, a stable and dense anti-seepage area can be formed after grouting.

9. The I-shaped water-retaining dam for an underground reservoir in a coal mine according to claim 1, wherein multiple groups of anchor rods are arranged at a joint between a part of the lower flange plate embedded into the floor surrounding rock and the floor surrounding rock in a width direction of the dam body; the anchor rod passes through a loose layer of the floor surrounding rock and is inserted into stable rock mass.

10. The I-shaped water-retaining dam for an underground reservoir in a coal mine according to claim 9, wherein there are three anchor rods in each group of anchor rods, wherein one anchor rod is perpendicular to the lower flange plate, the other two anchor rods are symmetrically distributed at an angle of 45° from a horizontal direction of the lower flange plate, and in this way, a stable and dense anti-seepage area can be formed after grouting.

11. The I-shaped water-retaining dam for an underground reservoir in a coal mine according to claim 1, wherein multiple rows of anchor rods are inserted at a joint between an embedded part on two sides of the web plate and the coal pillar dams in a height direction of the dam body; each row of anchor rods is arranged perpendicular to the coal pillar dam; and the anchor rod passes through a loose layer of the coal pillar dam and is inserted into a stable coal pillar dam.

12. The I-shaped water-retaining dam for an underground reservoir in a coal mine according to claim 1, wherein multiple joist steels arranged in a # shape are disposed inside the web plate.

13. The I-shaped water-retaining dam for an underground reservoir in a coal mine according to claim 12, wherein the vertical joist steel extends into the upper flange plate and lower flange plate.

14. The I-shaped water-retaining dam for an underground reservoir in a coal mine according to claim 1, wherein an anti-seepage layer and a support layer are further successively arranged on a side of the web plate facing the underground reservoir, and the web plate, the anti-seepage layer, and the support layer form the I-shaped water-retaining dam of a multilayer dam body structure.

15. The I-shaped water-retaining dam for an underground reservoir in a coal mine according to claim 14, wherein the anti-seepage layer is a gravel structure layer or a loess structure layer with a thickness of 1.5-2.5 m.

16. The I-shaped water-retaining dam for an underground reservoir in a coal mine according to claim 14, wherein the support layer is a brick-concrete structure layer with a thickness of 1.5-2.0 m.

17. The I-shaped water-retaining dam for an underground reservoir in a coal mine according to claim 14, wherein a waterproof layer is coated between the support layer, the anti-seepage layer, and the web plate.

* * * * *